United States Patent [19]

Jackson

[11] Patent Number: 4,834,914

[45] Date of Patent: May 30, 1989

[54] RADIOACTIVE WASTE DISPOSAL SYSTEM AND METHOD

[76] Inventor: O. L. Jackson, Post Office Box 1627, Brooksville, Fla. 34298-1627

[21] Appl. No.: 59,691

[22] Filed: Jun. 9, 1987

[51] Int. Cl.[4] ..... G21F 9/12; G21F 9/24

[52] U.S. Cl. ..... 252/633; 100/41; 100/93 R; 159/47.3; 159/DIG. 12; 250/506.1; 252/628; 252/632; 264/176.1; 264/211.12; 264/211.2; 425/DIG. 16; 425/DIG. 243

[58] Field of Search ..... 252/633, 631, 628, 632; 250/506.1, 507.1; 376/272; 100/38, 41, 904, 93 R; 264/0.5, 2.6, 125, 176.1, 177.11, 211.12, 211.21, 320, 141, 144; 34/12; 521/28; 159/DIG. 12, 47.3; 366/24, 154; 425/203, 207, 209, DIG. 245, DIG. 243, 381.2, DIG. 16, 131.1, 404; 414/146

[56] References Cited

U.S. PATENT DOCUMENTS

| | | | |
|---|---|---|---|
| 4,242,220 | 12/1980 | Sato | 264/0.5 |
| 4,280,922 | 7/1981 | Puthawala et al. | 264/0.5 |
| 4,460,499 | 7/1984 | Boden | 252/628 |
| 4,661,290 | 4/1987 | Sauda et al. | 252/626 |

FOREIGN PATENT DOCUMENTS

| | | | |
|---|---|---|---|
| 2631326 | 1/1978 | Fed. Rep. of Germany | 252/628 |
| 2090045 | 6/1982 | United Kingdom | 252/628 |

*Primary Examiner*—Howard J. Locker

*Attorney, Agent, or Firm*—Sughrue, Mion, Zinn, Macpeak and Seas

[57] ABSTRACT

Dry, compactable radioactive waste material having a low specific activity and comprised approximately of eighty-five percent plastic material and fifteen percent non-plastic material is shredded and granulated. The granulated material is supplied under heat and pressure to an extruder which will extrude the waste material in plasticized form into a drum for disposal. Radioactive ion exchange resin beads may also be dewatered and mixed in predetermined amounts with the dry granulated material for encapsulation within the plasticized waste for disposal. The plasticized waste material, with or without the resin, is horizontally extruded into a horizontally disposed drum between a compacting disk secured to the extruder barrel and the bottom of the drum. Controlled pressure is applied against the bottom of the drum whereby the plasticized material will completely fill the space between the disk and the bottom of the drum and gradually push the drum bottom away from the disk as the drum is filled.

6 Claims, 2 Drawing Sheets

RADIOACTIVE WASTE DISPOSAL SYSTEM AND METHOD

BACKGROUND OF THE INVENTION

The present invention is directed to a radioactive waste disposal system and more specifically to a method and apparatus for shredding and compacting radioactive waste material having a high percentage of plastic material of low specific, activity with predetermined amounts of radioactive ion exchange resin beads and subsequently heating and extruding the waste material into a sealable container without the addition of non-radioactive polymeric material.

Two different types of waste disposal systems are generally required for radioactive waste material having low specific activity and waste material which has a higher level of radioactivity. The waste material having a low specific activity, hereinafter referred to as LSA material, usually consists of packaging materials, protective material and the like which contain a high percentage of plastic material. In Applicant's prior U.S. Pat. No. 4,462,310, granted Jul. 31, 1984, the LSA material was compacted in a barrel or drum by means of a compacting device which was inserted in the barrel. The packing device included a base member having a peripheral configuration complementary t the cross-sectional configuration of the barrel, a plurality of threaded rods secured in spaced locations about the periphery of the base member and adapted to extend upwardly into proximity to the open end of the barrel, a supporting band secured to the ends of the rods opposite the base member, at least one intermediate plate having a peripheral configuration substantially the same as the base member and adapted to be disposed between the rods parallel to the base member and locking means secured to the intermediate plate and disposed in engagement with the threaded rods to allow movement of the intermediate plate toward the base member while preventing movement of the plate in the opposite direction. Thus after the insertion of a predetermined amount of compactable LSA material into the drum an intermediate plate would be inserted into the drum and pressed downwardly to compact the material and hold it in compacted condition while additional compactable material was added to the barrel. When the barrel was completely filled with compactable material a cover was secured to the drum and the drum could be disposed of in accordance with accepted procedures. Other radioactive waste material having a higher level of radioactivity could not be disposed of by such a method and other more complicated and expensive methods were required to dispose such radioactive material.

One system of disposing of such highly radioactive material, such as ion exchange resin bead wastes, is disclosed in the Gay et al, U.S. Pat No. 4,559,170, granted Dec. 17, 1985. According to this system the water present in the ion exchange resin bead waste is removed by heating the resin waste to a temperature sufficient to vaporize the water on the surface of the resin beads and to remove the water inside the ion exchange resin beads but insufficient to oxidize and combust the ion exchange resin bead waste. A dry flowable radioactive solid product is thereby produced which may be readily disposed of by conventional means such as storage, burial or incorporation into a solid matrix. Because of the makeup of the ion exchange resin beads and certain polymeric matrices used in monolithic storage, a polymeric matrix was used in order to incorporate large quantities of dry ion exchange resin beads into the monolith resulting from the polymerization of the matrix forming co-monomers.

The Bustard et al, U.S. Pat. No. 4,230,597, granted Oct. 28, 1980, also discloses a system for converting radioactive waste materials into solid form by mixing the radioactive waste with a novel polymeric formulation which when solidified forms a solid, substantially rigid matrix that contains and entraps the radioactive waste. The polymeric formulation comprises, in certain significant proportions by weight, urea-formaldehyde, methylated urea-formaldehyde, urea and a plasticizer. The radioactive waste in the form of a liquid or slurry is mixed with the polymeric formulation and the mixture is then treated with an acetic catalysing agent such as sulfuric acid. This mixture is then passed to a disposable container so that upon solidification of the radioactive waste entrapped within the matrix formed by the polymeric formulation, the radioactive waste may be safely and effectively stored at a disposal site.

Similar systems for disposing of radioactive waste are disclosed in the Gablin et al, U.S. Pat. No. 4,168,243, granted Sept. 18, 1979, and the Stock et al, U.S. Pat. No. 3,940,628, granted Feb. 24, 1976. The systems disclosed in these patents and the foregoing patents directed to the solidification of radioactive waste material all require the addition of a solidifying matrix such as a cement, a polymer matrix or the like. Thus the amount of radioactive waste material which can be disposed of in a single container is restricted by the amount of matrix necessary to solidify or encapsulate the waste material and the cost of the system is usually increased due to the necessity of adding an extraneous solidifying agent.

SUMMARY THE INVENTION

The present invention is directed to a new and improved radioactive waste disposal system which overcomes all of the problems associated with the prior art disposal systems discussed above.

The present invention provides a new and improved radioactive waste disposal system suitable for disposing of LSA materials, either alone or in combination with predetermined amounts of resin beads having a higher degree of radioactivity, wherein the LSA material is comprised of a high percentage of plastic (PVC) materials. The LSA material is fed to a shredder and the shredded material is processed through a granulator to reduce the material to the desired size particles. The radioactive resin beads to be added are injected into the granulated material and the mixture is passed through a dryer which will remove moisture from the materials while performing a thorough mixing of the materials. The dried and mixed material will then be fed to a stuffing box from which the material will be carried to an extruder barrel under pressure by means of a feeder screw. The extruder will plasticize the plastic material and the non-plastic material will serve as a filler material and the mixture will be extruded into a horizontally disposed steel drum through a compacting disk rigidly secured to the end of the extruder barrel. The plasticized material will enter the drum and create a pressure between the disk and the drum bottom thereby forcing the drum against a hydraulic or air cylinder causing it to retract as the extruded material fills the drum. Suitable heating may be provided for the drum and upon filling of the drum the pressure on the cylinder will be released and the drum can be removed for subsequent cooling prior t sealing. Suitable vent hoods may be provided in the vicinity of the shredder-granulator apparatus and in the vicinity of the extrusion of the plastic material into the drum.

The foregoing and other objects, features and advantages of the invention will be apparent from the following more particular description of a preferred embodiment of the invention as illustrated in the accompanying drawings.

DETAILED DESCRIPTION OF THE INVENTION

A survey of nuclear generating facilities reveals that, on the average, the LSA material that is generated contains seventy-two percent plastic and twenty-eight percent non-plastic material. Although the radioactive waste disposal system according to the present invention will work successfully with a ratio of sixty-five percent plastic and thirty-five percent non-plastic material it has been found that the optimum ratio would be eighty-five percent plastic and fifteen percent non-plastic material.

The material must be presorted to remove all noticeable metal objects which would be non-compactable and to insure a reasonable plastic/non-plastic mix. Preweighing of the unsorted material may be required to insure a proper mixture. The plastic and non-plastic material should be prepared in relatively large batches and accumulated in suitable storage facilities to permit efficient startup and an extended run of the equipment.

Figure 1:
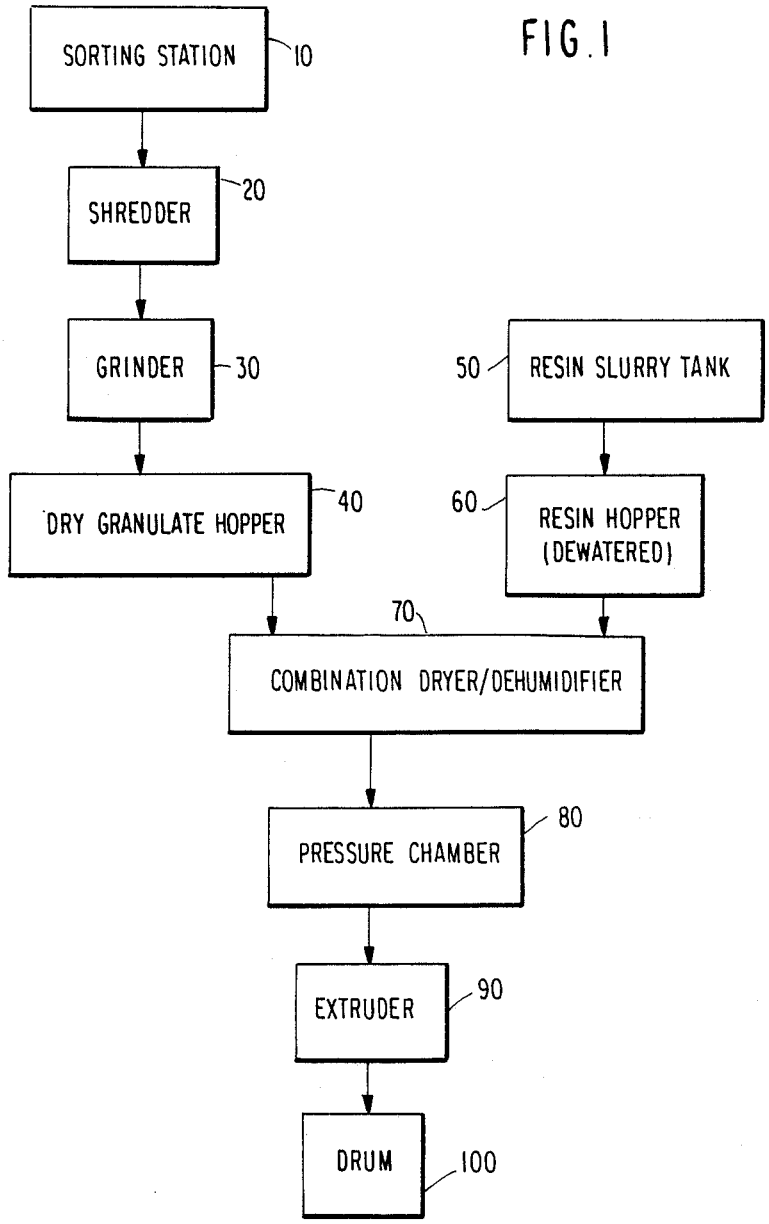
FIG. 1 is a diagrammatic flow chart showing a system according to the present invention.

The overall system for handling the radioactive waste material is best understood by reference to the diagrammatic flow chart of FIG. 1. The above described sorting of the radioactive waste material takes place at a sorting station 10 from which the desired ratio of plastic/non-plastic material is supplied to a shredder 20. The shredded material will then pass to a grinder 30 wherein the material is granulated and supplied to a dry granular hopper 40. Radioactive ion exchange resin beads are collected in a resin slurry tank 50. The radioactive resin material is conveyed to a resin hopper 60 by means of a dewatering screw conveyor.

The granular material from the hopper 40 and the dewatered resin beads from the hopper 60 are then supplied in the proper ratio to a combination dryer/-dehumidifier 70 wherein granular material and the resin beads will be thoroughly mixed and dried. The mixture will then pass to a pressure crammer 80 for compacting and supplying the mixture by means of a screw compactor to the extruder 90 from which the mixture will be extruded in plastic form into a fifty-five gallon ,sealed drum 100 which is suitable for storage and disposal of the waste material. A metal detector/separator (not shown) may be located in the granular stream of material from the combination dryer/ dehumidifier 70 to the pressure crammer 80. Such a metal detector permits the detection and removal of all minor metal particles which may have been processed through the shredder-grinder system before they reach the extruder to protect the extruder barrel and its inner components from damage.

Figure 2:
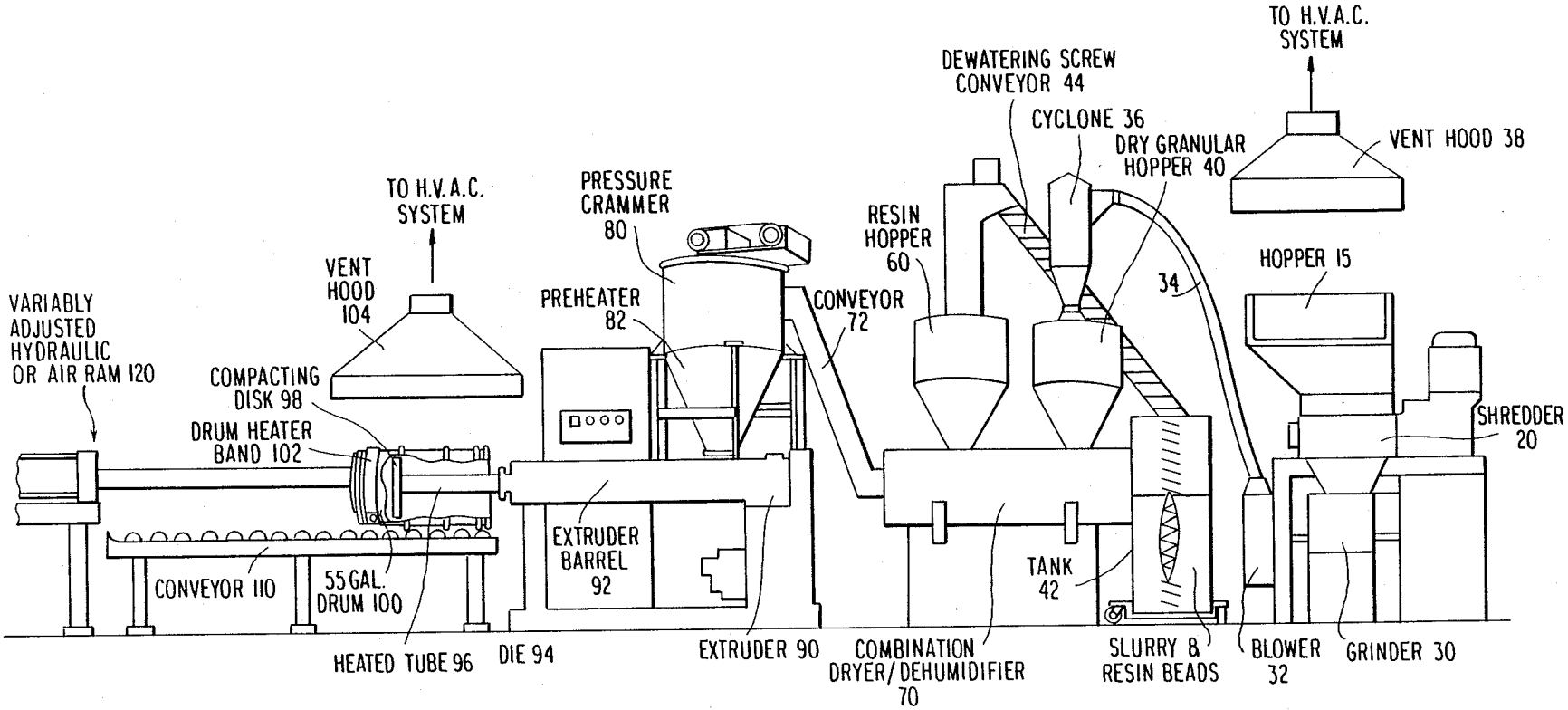
FIG. 2 is a side elevation view, partly in section, showing the apparatus comprising the system according to the present invention.

A practical arrangement of the apparatus for carrying out the flow process shown in FIG. 1 has been illustrated in FIG. 2. The sorting station 10 referred to in FIG. 1 is not shown in FIG. 2 nor are the storage facilities for the sorted material. The sorted material, however, is supplied to the hopper 15 of the shredder 20 in the proper ratio of plastic and non-plastic material by any suitable means. The shredder 20 may be a Wor-Tex Heavy Duty Shredder Model Number 1560-TS having a hopper capacity of thirty cubic feet. The shredded material will be gravity fed to a suitable grinder 30 which may be Wor-Tex Granulator Model Number XL-15 which is capable of granulating up to fifteen hundred pounds of material per hour. The granulate output of the grinder 30 is transferred by means of a blower 32 through a conduit 34 to a cyclone 36 located on the top of a dry granular hopper 40. A shredder vent hood 38 is provided above the hopper 15 for the shredder for collecting any dust or loose particles from the flow of waste material to the hopper 15 and transporting the dust to a HVAC system for suitable disposable. Any dust or the like created by the shredder grinder combination will be conveyed to the cyclone since the cyclone blower will create a negative pressure in this area.

The radioactive ion exchange resin beads to be disposed of have a considerably higher level of radioactivity than the LSA material described above. The ion exchange resin beads may contain any one or several of the radioactive isotopes frequently encountered in the wastes of nuclear power plants and have a level of radioactivity in excess of one microcurie per cc. A slurry of water and the resin beads is contained in portable tank 42. The resin material is transferred from the tank 42 by means of a dewatering screw conveyor 44 and the dewatered resin is supplied to a resin hopper 60 wherein the resin will be stored for subsequent metering in the proper proportions with the dry granular LSA material in the hopper 40. The hoppers 40 and 60 are mounted on top of a combination dryer/dehumidifier 70 and the materials from the respective hoppers are metered by conventional means into the dryer 70. The dryer maybe a Whitlock Model Number DB-200 Dehumidifying Dryer. The dried resin and granulate materials which have been thoroughly mixed in the dryer 70 are then transferred by means of a suitable conveyor 72 into a pressure crammer 80 mounted above the extruder 90. The pressure crammer or stuffing box 80 may be an HPM Model Number 35-SCF which contains a feeder screw (not shown) to carry the resin and granulate material into the extruder barrel 92 under pressure. The lower portion of the stuffing box 80 contains a preheater 82 which will heat the material prior to entry into the extruder barrel.

The extruder, which may be an HPM Extruder, Model TMC having a 3.5 inch bore and an extrusion screw, is connected at its inlet end to the lower end of the stuffing box 80. The barrel also contains a thermostatically controlled heater to bring the plastic products to the required temperature for extruding. By controlling the end temperature of the material to be extruded it is possible to prevent the PVC content from degrading, which would cause toxic fumes. The extruder will "plasticize" the plastic material and the non-plastic material will serve as a "filler" material and be extruded along with the resin beads within the plastic through a horizontally disposed die 94.

The extruded material will then pass through a heated metal tube 96 having a compacting disk 98 secured to the end of the tube 96. The disk 98 is provided with a central aperture which will be aligned with the outlet of the metal tube so that the plasticized material will be extruded into the bottom of a horizontally disposed drum. The standard acceptable drum for disposable of radioactive waste material is fifty-five gallon steel drum. The drum 100 is mounted on a conveyor 110. A variably adjusted hydraulic or air ram 120 is mounted at one end of the conveyor 110 with the end of the ram 120 engaging the bottom of the barrel 100 so as to resist axial movement of the barrel 100 along the conveyor 110 away from the compacting disk 98. The extruded material will be compressed between the bottom of the drum and the disk so as to completely eliminate voids in the extruded material. The drum will be pressed away from the extruder by the force of the extrusion and will compress the ram which has a variable adjustment and a visual pressure gauge. When the barrel 100 is completely filled the ram can be retracted to release the drum which can then be removed from the drum conveyor 110 onto any suitable transport means. During the filling of the drum 100 a drum heater band 102 may be placed about the circumference of the drum to maintain the extruded material in the plastic state so that the material will completely fill the space between the bottom of the drum and the compacting disk without any voids. A drum vent hood 104 is disposed above the barrel 100 in its filling position so as to capture any fumes which may escape from the extruder or the barrel and transport such fumes to an HVAC system.

Although larger pieces of metallic waste were removed from the waste material during the initial sorting operation prior to shredding, small pieces of metal will sometimes be included in the dried resin and granular material. It may therefore be desirable to include a metal detector/separator such as the metal detector/-separator manufactured by Loersch Corporation, Model Number DS-1000-50 between the dryer 70 and the pressure crammer 80. The metal detector/separator can detect and remove steel particles as small as a steel ball having a diameter of 0.020 inches. Thus the removal of the small metal particles will protect the extruder barrel and die from undue wear or damage.

In summary, the system according to the present invention is intended to accommodate one hundred percent of the low specific activity material (dry, compactable, radioactive waste) generated by a nuclear facility. In addition to the processing of this LSA material to a maximum pounds per cubic foot ratio the present invention permits the addition of Class "B" resin (greater than one microcurie per cubic centimeter) to the LSA material for disposal as Class "A" radioactive waste. The LSA material and the resin will be encapsulated in a solid plastic block inside a fifty-five gallon drum which meets all of the requirements of Regulation 49 CFR as a strong, tight container for shipping radioactive LSA material.

Generally, the advantages of the system according to the present invention over existing improved methods of disposal are numerous. At the present time, all LSA material that is generated by all nuclear generating plants in the United States is processed by one of several compacting methods. No matter how much presorting, shredding or other handling this LSA material receives prior to final disposal, it all ends up being compacted either in fifty-five gallon drums or in LSA boxes (4'×4'×6').

Most nuclear plants use some type of anti-spring back device in order to improve their compacting performance. The spring back device disclosed in the above identified U.S. Pat. No. 4,462,310, produces the highest recorded pounds per cubic feet ratios in the industry.

None of the compacting applications presently in use permit the inclusion of radioactive resins in their process. While all of the compacted LSA material is now shipped to the radioactive burial sites as Class "A" material, all resins must be shipped as Class "B" radioactive waste. At a typical nuclear power plant the resins represent only a small percentage of the disposable radioactive waste, however, they account for more than fifty percent of the annual budget for waste disposal.

The present LSA resin processing system provides the maximum pound/cubic foot densities for all the compactable LSA material, permits small amounts of resin to be added to each extruded drum of material which would eliminate special containers and the requirement for Class "B" resin shipments and provides a means of disposal as a solid for all the LSA and resins now being generated in the United States. This eliminates the seepage of the material at the disposal sites after the original containers have deteriorated.

An alternative arrangement for extruding the plasticized mixture into a drum includes positioning a vertically disposed open drum on a vertically moveable support and extending a downwardly angled nozzle of the extruder into the drum adjacent the bottom thereof. As the extrudate fills the drum the support therefor will be gradually lowered. The drum may be heated to facilitate the flow of the extrudate to prevent voids. It is also possible to maintain the drum stationary so that a pressure plate secured to the end of a flexible nozzle will gradually rise a the extrudate fills the drum to prevent voids.

While the invention has been particularly shown and described with reference to preferred embodiments thereof it will be understood by those in the art that the foregoing and other changes in form and details may be made therein without departing from the spirit and scope of the invention.

What is claimed is:

1. A radioactive waste disposal system comprising grinding means for granulating dry compactable plastic and non-plastic LSA material to provide a mixture of granulated material according to a predetermined ratio of plastic to non-plastic material and heated extrusion means operatively connected to said grinder means for plasticizing the granulated material and extruding the plasticized material into a container for subsequent solidification and disposal, combination dryer and mixing means disposed intermediate said grind means and said extrusion means, first feed means for supplying a measured amount of said dry granulated LSA material from said grinder means to said dryer and mixing means, second feed means supplying a measured amount of wet, radioactive resin to said dryer and mixing means and conveyor means for conveying a dried mixture of resin and granulate from said dryer and mixing means to said extrusion means.

2. A radioactive waste disposal system comprising grinding means for granulating dry compactable plastic and non-plastic LSA material to provide a mixture of granulated material according to a predetermined ratio of plastic to non-plastic material and heated extrusion means operatively connected to said grinder means for plasticizing the granulated material and extruding the plasticized material into a container for subsequent solidification and disposal and wherein said extrusion means is comprised of pressure crammer means having preheating means, heated extruder barrel means having an inlet connected to said pressure crammer means for receiving preheated radioactive waste materials under pressure and an outlet end having a die adapted to extrude the radioactive waste material in plasticized form into a drum and wherein said extruder barrel means is horizontally disposed and said die is provided with a heated horizontally disposed extension tube having an apertured compacting disk secured to one end thereof and adapted to be disposed within a horizontally disposed drum and further comprising conveyor means for supporting said drum for horizontal movement relative to said compacting disk and adjustable pressure means adapted to bear against said drum to controllably resist movement of the bottom of the drum away from said compacting disk as plasticized material is extruded into said drum.

3. A radioactive waste disposal system as set forth in claim 1 wherein said extrusion means is comprised of pressure crammer means having preheating means, heated extruder barrel means having an inlet connected to said pressure crammer means for receiving preheated radioactive waste materials under pressure and an outlet end having a die adapted to extrude the radioactive waste material in plasticized form into a container.

4. A radioactive waste disposal system as set forth in claim 3 wherein said extruder barrel means is horizontally disposed and said die is provided with a heated horizontally disposed extension tube having an apertured compacting disk secured to one end thereof and adapted to be disposed within a horizontally disposed drum and further comprising conveyor means for supporting said drum for horizontal movement relative to said compacting disk and adjustable pressure means adapted to bear against said drum to controllably resist movement of the bottom of the drum away from said compacting disk as plasticized material is extruded into said drum.

5. A process for disposing of radioactive waste comprising granulating dry compactable plastic and non-plastic radioactive LSA material to provide granulated LSA material having a predetermined ratio of plastic to non-plastic material, supplying the granulated LSA material under heat and pressure to a heated extruder, extruding the LSA material in plasticized form into a drum form for solidification and disposal, dewatering radioactive resin material having a higher level of radioactive activity than the LSA material, supplying the dewatered resin material and the granulated LSA material in a predetermined ratio to a combination dryer and mixer and supplying the dried mixture of resin and granulated LSA material to the extruder means.

6. A process for disposing of radioactive waste as set forth in claim 5 further comprising extruding the waste material in plasticized form into a horizontally disposed drums between the bottom of the drum and compacting disk secured to said extruder and applying controlled pressure to the bottom of the drum so that the plasticized material will completely fill the space between the bottom of the drum and the compacting disk without any void and gradually push the bottom of the drum away from the compacting disk until the drum is filled to the desired level.

* * * * *

UNITED STATES PATENT AND TRADEMARK OFFICE

CERTIFICATE OF CORRECTION

PATENT NO. : 4,834,914

DATED : May 30, 1989

INVENTOR(S) : O. L. Jackson

It is certified that error appears in the above-identified patent and that said Letters Patent is hereby corrected as shown below:

Column 1, line 27, delete "t", and insert --to--.

Column 6, line 57, delete "grind", and insert --grinder--.

Signed and Sealed this

Twenty-sixth Day of March, 1991

*Attest:*

HARRY F. MANBECK, JR.

*Attesting Officer*

*Commissioner of Patents and Trademarks*